US008445072B2

(12) United States Patent
Güthner et al.

(10) Patent No.: US 8,445,072 B2
(45) Date of Patent: May 21, 2013

(54) METHOD FOR TREATING WOODEN PARTS

(75) Inventors: Thomas Güthner, Trostberg (DE); Jürgen Sans, Trostberg (DE)

(73) Assignee: AlzChem Trostberg GmbH, Trostberg (DE)

( * ) Notice: Subject to any disclaimer, the term of this patent is extended or adjusted under 35 U.S.C. 154(b) by 389 days.

(21) Appl. No.: 12/449,339

(22) PCT Filed: Jan. 30, 2008

(86) PCT No.: PCT/EP2008/000729

§ 371 (c)(1), (2), (4) Date: Aug. 3, 2009

(87) PCT Pub. No.: WO2008/095635

PCT Pub. Date: Aug. 14, 2008

(65) Prior Publication Data

US 2010/0003411 A1 Jan. 7, 2010

(30) Foreign Application Priority Data

Feb. 3, 2007 (DE) ..... 10 2007 005 527

(51) Int. Cl.
*B05D 3/02* (2006.01)

(52) U.S. Cl.
USPC ..... 427/397; 427/384; 427/394; 427/396

(58) Field of Classification Search
USPC ..... 427/397, 396, 394, 384
See application file for complete search history.

(56) References Cited

U.S. PATENT DOCUMENTS

| | | | | |
|---|---|---|---|---|
| 2,386,471 | A * | 10/1945 | Jones et al. | 106/18.15 |
| 2,530,261 | A * | 11/1950 | Ward et al. | 8/182 |
| 3,483,184 | A | 12/1969 | Chamberlain | |
| 3,567,359 | A | 3/1971 | Blackburn et al. | |
| 3,874,912 | A * | 4/1975 | Swidler et al. | 442/143 |
| 5,094,890 | A | 3/1992 | Smith et al. | |
| 5,990,043 | A * | 11/1999 | Kugler et al. | 504/150 |
| 6,306,317 | B1 * | 10/2001 | Richards et al. | 252/607 |
| 6,517,748 | B2 | 2/2003 | Richards et al. | |
| 7,622,517 | B2 * | 11/2009 | Bauer et al. | 524/13 |
| 2002/0011593 | A1 | 1/2002 | Richards et al. | |
| 2007/0278463 | A1 * | 12/2007 | Ratzsch et al. | 252/607 |

FOREIGN PATENT DOCUMENTS

| | | | |
|---|---|---|---|
| DE | 609734 | C | 2/1935 |
| DE | 657599 | C | 3/1938 |
| DE | 837925 | C | 5/1952 |
| DE | 1172798 | B | 6/1964 |
| DE | 1619047 | A1 | 9/1969 |
| EP | 0278641 | A1 | 8/1988 |
| GB | 609734 | | 8/1946 |
| GB | 657599 | | 9/1946 |
| GB | 600961 | A | 4/1948 |
| JP | 48023399 | | 7/1973 |
| WO | WO-91/00327 | A1 | 1/1991 |

* cited by examiner

*Primary Examiner* — Robert S Walters, Jr.
(74) *Attorney, Agent, or Firm* — Fulbright & Jaworski LLP

(57) ABSTRACT

A method of treating wooden parts is described in which a) the wooden parts are impregnated with an aqueous cyanamide solution and subsequently b) the impregnated wooden parts, where appropriate after drying, are subjected to a heat treatment of 130 to 250° C. Here it has surprisingly emerged that impregnation with cyanamide even in small amounts has a significantly positive influence on the performance properties of the treated wooden parts, such as high hardness, low water absorption and very good weathering stability, for example. Moreover, only small amounts of a toxicologically and environmentally unobjectionable impregnating agent are needed in order to obtain these advantageous properties.

21 Claims, 3 Drawing Sheets

METHOD FOR TREATING WOODEN PARTS

RELATED APPLICATIONS

This application is a §371 application from PCT/EP2008/000729 filed Jan. 30, 2008 which claims priority from German Application Serial No. 10 2007 005 527.9 filed Feb. 3, 2007, each of which is herein incorporated by reference in its entirety.

The present invention concerns a method for treating wooden parts for improving their performance properties such as hardness, water absorption and weatherproofness.

BACKGROUND OF THE INVENTION

Precious tropical woods are preferred over native woods for demanding wooden structures in interior and exterior areas because they have advantageous properties. On the other hand, the increased use of precious tropical woods leads to the decimation of tropical rainforests and should therefore be rejected for ecological reasons. Moreover, sufficient amounts of local hardwoods and softwoods are available, which, however, often do not meet the technical demands.

This dilemma gave rise to the idea of thermally treating low-grade woods to improve their properties. According to EP 0 759 137 A1 and EP 0 695 408 A1 methods are for example described for modifying woods by the application of elevated temperatures in such a manner that they cover a profile of requirements which can usually only be achieved by precious tropical woods. In particular their resistance towards mildew and rot is improved. A disadvantage is that the treatment has to take place at high temperatures of more than 200° C. and that some of the resulting properties cannot be improved to the desired degree.

As an alternative methods are known in which wood is modified by impregnation with reactive monomers and the subsequent cross-linking of the same. Such methods are known for example from WO 2006/117 159 A1 and WO 2004/033 171 A1. Wooden materials are formed which have a high degree of hardness, weatherproofness and dimensional stability. However, a disadvantage is that large amounts of impregnating agents have to be used which additionally considerably increase the specific weight of the wooden material. Furthermore, the formaldehyde content of the impregnating agents that are used results in undesired emissions from the wooden material.

The treatment of cellulose-containing materials with cyanamide is basically known. Thus, as described in U.S. Pat. No. 3,051,698 and U.S. Pat. No. 3,380,799, cellulose is treated with cyanamide at pH values above 8.5 and subsequently acidified which results in cationically modified celluloses with ionic properties which are for example suitable as adsorption agents.

When cellulose fibres are reacted at room temperature with cyanamide, reactive aldehydes and amines according to DE 16 19 047 A1 polymer-modified celluloses are formed which are particularly suitable for electro-insulating papers.

However, no method for treating cellulose-containing materials and in particular wood with cyanamide is known in which the addition of further reactive substances can be dispensed with.

BRIEF SUMMARY OF THE INVENTION

The object of the present invention was therefore to develop a method for modifying wooden parts in the form of wood or wooden materials which does not have the said disadvantages of the prior art but rather improves the known methods for thermally treating wood with an impregnation method in such a manner that only small amounts of a toxicologically and ecologically harmless impregnating agent are required and nevertheless advantageous properties are obtained.

This object was achieved according to the invention in that a) the wooden parts are impregnated with an aqueous cyanamide solution and subsequently b) the impregnated wooden parts, where appropriate after drying, are subjected to a heat treatment of 130 to 250° C.

It has namely surprisingly turned out that impregnation with cyanamide even in small amounts has a substantial positive effect on the properties of the resulting woods and that the heat treatment triggers a specific cross-linking reaction between cyanamide and reactive groups within the wood structure. Surprisingly cyanamide is thus bound irreversibly into the wood structure and improves the technical properties of the woods treated in this manner.

In the method according to the present invention the wooden parts in the form of woods or wooden materials are firstly subjected to an impregnation with cyanamide (step a)) and subsequently a heat treatment (step b)).

In this process inexpensive hardwoods and softwoods of the temperate zone are treated which preferably originate from sustainable forestry. Examples are the European woods spruce, fir, pine, birch, beech such as e.g. copper beech or hornbeam, maple, poplar, alder, lime, Douglas fir, ash and oak as well as non-European woods with an analogous property profile.

The woods are preferably present as solid woods (boards, planks, battens). They can, however, also be present in the form of veneers or shavings which are subsequently used to manufacture wooden materials. Alternatively it is also possible to treat finished wooden materials plywood, chipboards, fibreboards, OSB boards, glued wood) using the method according to the invention.

The said woods and wooden materials are preferably impregnated with a solution containing cyanamide by applying a vacuum and/or pressure. Devices such as those which are usually used for the boiler pressure impregnation of woods are suitable for this purpose.

The aqueous impregnating solution should preferably contain 1 to 50% by weight cyanamide, particularly preferably 5 to 25% by weight cyanamide and in particular 10 to 15% by weight cyanamide. The pH of the impregnating solution should be in the range of 3.0 to 7.0, preferably pH 4.0 to 5.5 or pH 4.5 to 5.0. The impregnating solution can optionally contain further substances in which case water-soluble wood preservatives known to a person skilled in the art are preferred in a concentration range of 0.01 to 5.0% by weight in each case. Typical examples of such additives are for example fungicides, insecticides or biocides such as e.g. copper compounds, fluorides, borates, silicates, phenol, 1,2,4-triazoles, insecticidal phosphoric acid esters or neonicotinoid insecticides. Phosphates, borates or sulfamates can be added to improve the flame resistance of the woods or wooden materials. They may additionally contain pigments and/or dyes and/or substances that absorb ultraviolet light.

In a preferred embodiment the aqueous cyanamide solution additionally contains surface-active substances preferably in an amount of 0.02 to 0.2% by weight, in particular 0.05 to 0.015% by weight. The use of surface-active substances facilitates the impregnation of the wood and nonionic, cationic or anionic surfactants are particularly suitable for this.

The impregnation (step a)) advantageously takes place in a temperature range between 0 and 60° C., in particular 20 to 40° C. An impregnation of the wood with the impregnating solution which is as complete as possible can be achieved by applying a vacuum (0.02 to 0.98 bar) or pressure (1.02 to 15 bar) also in succession and in several cycles. For example pressure and vacuum treatment can be carried out alternately once to five times. Appropriate methods are known to a person skilled in the art.

The fact that the woods impregnated in this manner are subjected to a heat treatment, where appropriate after drying, is regarded as essential for the invention.

The optional drying of the woods impregnated with the aqueous cyanamide solution can take place at temperatures of 20 to 150° C., preferably at 40 to 130° C. where the external pressure is adjusted to 0.01 to 1.0 bar optionally by applying a vacuum. The drying time is several hours, preferably 1 to 24 hours.

However, it is also possible to dry the impregnated woods in a common process step together with the described heat treatment. According to this special variant of the method the drying is initiated by exposure to the temperature and pressure conditions intended for the heat treatment after which a continuous transition to heat treatment occurs.

The temperature range of the heat treatment is between 130 and 250° C., preferably 150 to 220° C., especially 170 to 200° C. The time period of heat treatment is 1 to 36 hours and times between 2 and 12 hours or 4 to 8 hours are preferred. The drying and subsequent heat treatment preferably takes place in several temperature steps in which the said temperature is approached in a stepwise manner.

The heat treatment can take place at normal pressure but also optionally under a pressure of up to 10 bar, e.g. at 3 to 7 bar where the atmosphere can preferably contain air, nitrogen, steam or a mixture thereof.

After the heat treatment, the treated woods have a residual moisture content of preferably less than 10%. They can be used as such as construction woods such as e.g. for load-bearing or non-load-bearing constructional elements in buildings, for doors, windows, furniture (in particular garden furniture) and wooden elements in gardening. Alternatively the treated woods (especially in the form of veneers, shavings etc.) can be used to produce wooden materials which in turn can be used for the said fields of application.

The wooden parts treated according to the invention are characterized by very good performance properties such as e.g. a high degree of hardness, low water absorption and very good weatherproofness.

On the basis of the observed property profiles it may be assumed that cyanamide reacts with the specific constituents of wood (cellulose, hemicellulose, lignin) in such a manner that after heat treatment it is covalently bound into the wood network even without the use of additional cross-linking agents and thus makes an important contribution to the improvement of the properties.

DETAILED DESCRIPTION OF THE INVENTION

The following examples are intended to further elucidate the essence of the invention.

EXAMPLES

Example 1

Test pieces in a 80×25×25 mm format are cut from homogeneous wooden material (spruce or birch), dried and weighed.

The test pieces are immersed in cyanamide solution (or water as a reference) and completely impregnated by evacuating two times. They were then dried at 60° C. in a vacuum.

Figure 1:
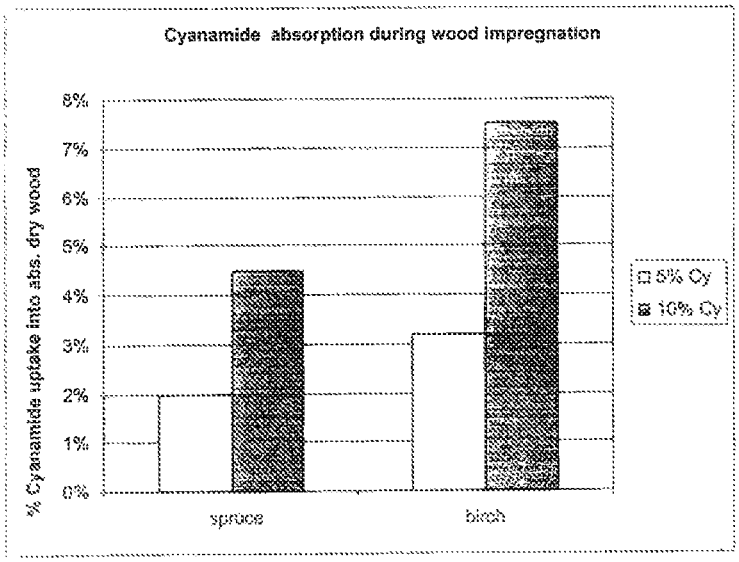
FIG. 1 shows the cyanamide absorption into the wood during wood impregnation.

As shown in FIG. 1, the absorption of cyanamide into the wood is proportional to the cyanamide concentration (5 or 10% by weight) of the impregnating solutions that were used.

Example 2

Figure 2:
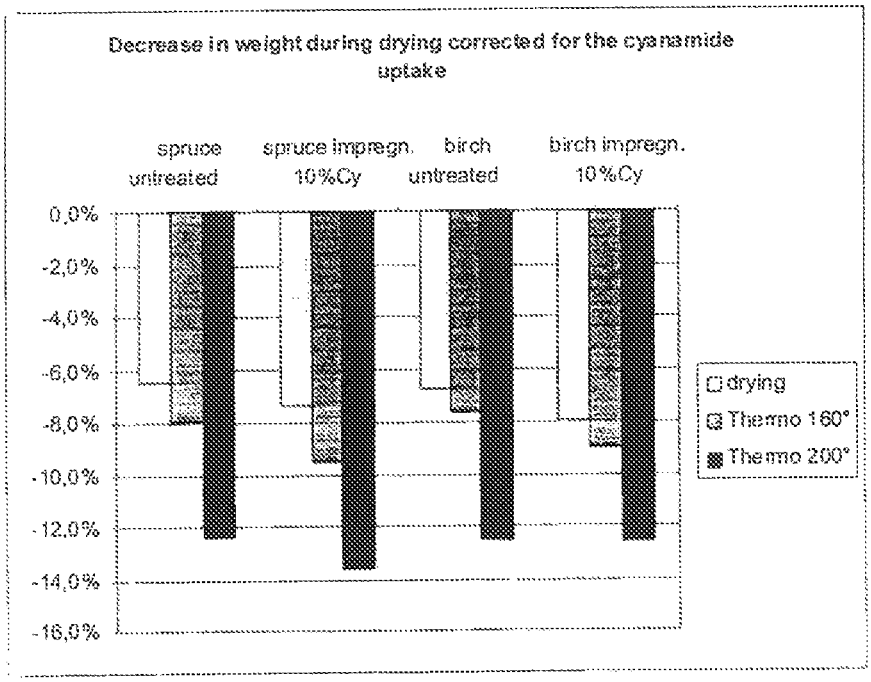
FIG. 2 shows the effects of cyanamide impregnation on the decrease in weight of the wood during heat treatment.

Test pieces which were impregnated with water or with 10% by weight cyanamide solution according to example 1, were thermally aftertreated at 160° C. (8 hours) or at 200° C. (3 hours). The water absorption or water release and the cyanamide absorption was determined from the weights of the test pieces (see FIG. 2).

As a result of the heat treatment the woods darken which by nature is stronger at 200° C. than at 160° C. Birch becomes approximately the colour of mahogany at 200° C. The presence of cyanamide has no effect on the colour. Only the cyanamide-treated spruce samples exhibited a yellow colouration which disappeared again upon heat treatment.

The decrease in weight during heat treatment exhibited two types of effects:

About 6% by weight bound water are released during gentle drying, at 160° C. the amount increases to 8% by weight, at 200° C. to 12% by weight. The reason is the known condensation of free OH groups in the wood with elimination of water.

If cyanamide is in the wood, more water is released during the heat treatment (corrected for the cyanamide weight) and namely additionally in each case about 30% by weight of the cyanamide weight at 160° C. and 200° C. This additional release of water is due to a reaction of cyanamide with OH groups in the wood structure.

Example 3

The woods treated according to example 2 were checked for their hardness. The results were:

| type of wood | impregnation | heat treatment | hardness |
|---|---|---|---|
| spruce | without | drying at 60° C. | low |
| spruce | without | heat treatment 200° C., 3 hours | medium |

-continued

| type of wood | impregnation | heat treatment | hardness |
|---|---|---|---|
| spruce | with 10% cyanamide solution | drying at 60° C. | low |
| spruce | with 10% cyanamide solution | heat treatment 200° C., 3 hours | high |
| birch | without | drying at 60° C. | medium |
| birch | without | heat treatment 200° C., 3 hours | high |
| birch | with 10% cyanamide solution | drying at 60° C. | medium |
| birch | with 10% cyanamide solution | heat treatment 200° C., 3 hours | very high |

Example 4

Figure 3:
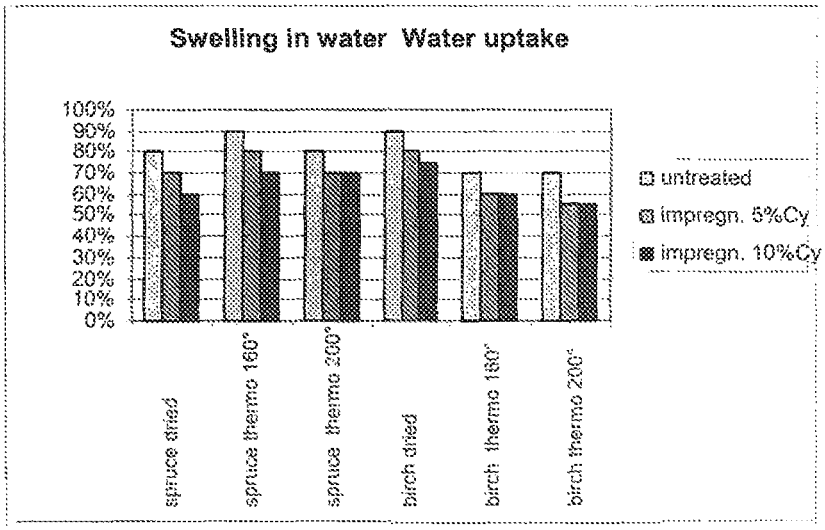
FIG. 3 shows the effects of cyanamide impregnation on water absorption of the wood after immersing in water.
Figure 4:
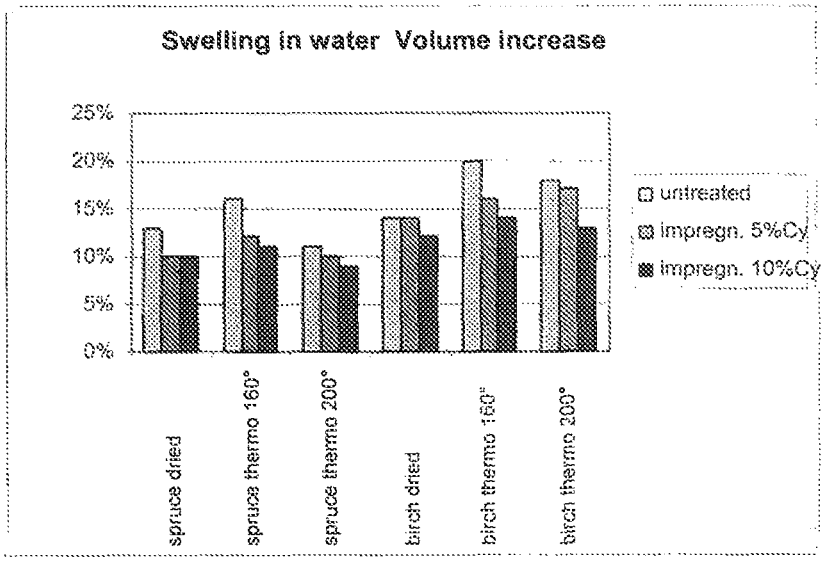
FIG. 4 shows the effects of cyanamide impregnation on volume increase of the wood after immersing in water.

The woods treated according to example 2 were immersed in water for 7 days at 20° C. The water absorption (as % by weight) and the increase in volume of the test pieces was determined (see FIGS. 3 and 4).

It was observed that, as expected, the water uptake is reduced by heat-treating the wood. The water absorption is further reduced when cyanamide is also present and the effect is proportional to the introduced amount of cyanamide.

The impregnation with cyanamide did not have a pronounced effect without a subsequent heat treatment. A chemical incorporation of cyanamide with a cross-linking of the wood structures may therefore be assumed.

Example 5

Figure 5:
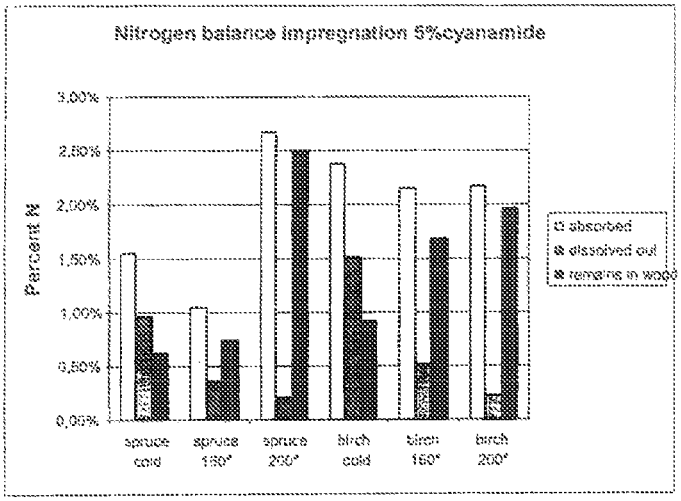
FIG. 5 shows the effects of 5% cyanamide impregnation on nitrogen balance in the wood.
Figure 6:
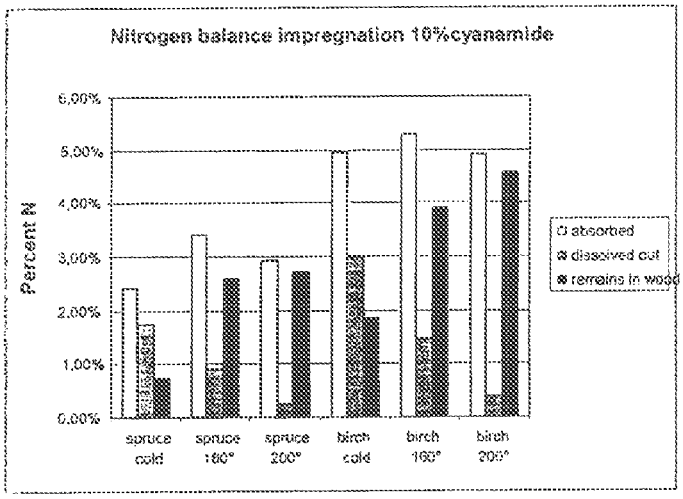
FIG. 6 shows the effects of 10% cyanamide impregnation on nitrogen balance in the wood.
Figure 7:
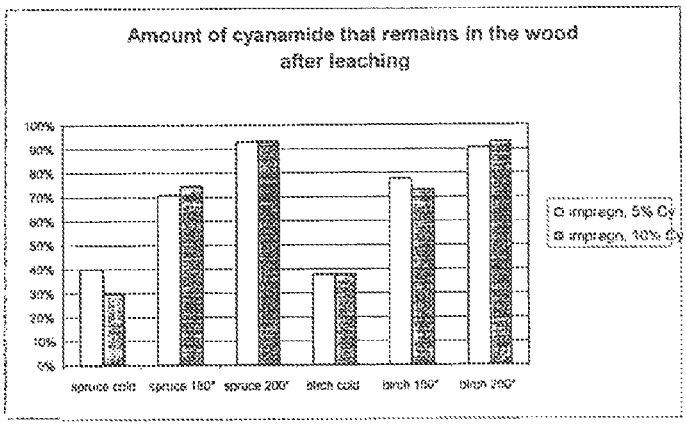
FIG. 7 shows the amounts of cyanamide that remain in the wood after leaching with 5% and 10% cyanamide impregnation.

The water in which the test pieces from example 4 were immersed was chemically analysed. This resulted in the following values of the analysis shown in FIGS. 5, 6 and 7:

Only about 30 to 40% by weight of the nitrogen introduced in the form of cyanamide was not extractable after impregnation and subsequent drying at 60° C.

More than 60 to 70% by weight of the nitrogen compounds in the water could be extracted by water. Over 90% by weight of the extractable nitrogen components consisted of unchanged cyanamide, in addition there was only a small amount of dicyandiamide and urea. Hence, this shows that the cyanamide treatment does not result in advantageous properties without a subsequent heat treatment.

After heat treatment at 160° C. about 70 to 80% by weight of the nitrogen introduced in the form of cyanamide could no longer be extracted by water.

Only about 20 to 30% by weight of the nitrogen compounds in the wood could be extracted by water. No cyanamide was detectable among the extracted nitrogen compounds. About 75% by weight of the extractable nitrogen components consisted of dicyandiamide, 5% by weight of urea, 5% by weight of guanidine and 10% by weight of melamine.

After heat treatment at 200° C.>90% by weight of the nitrogen introduced in the form of cyanamide could no longer be extracted i.e. was permanently bound to the wood.

Less than 10% of the nitrogen compounds in the wood could be extracted by water. No cyanamide was detectable among the extracted nitrogen compounds. About 40% by weight of the extractable nitrogen components consisted of melamine, 8% by weight of dicyandiamide, 12% by weight of urea and <5% by weight of guanidine. In addition further unidentified N compounds were detected.

This therefore shows that that heat treatment of the wood impregnated with cyanamide results in a specific reaction with complete chemical conversion of the cyanamide in which the reaction products of cyanamide are permanently bound into the wood structure. This therefore provides a chemical and mechanistic explanation for the surprising effect of the improvement of properties by impregnation with cyanamide and subsequent heat treatment.

Example 6

Wooden test pieces according to example 2 were exposed to weathering. After an exposure time of 12 months the resistance to weathering was estimated.

| type of wood | impregnation | heat treatment | Resistance to weathering |
|---|---|---|---|
| spruce | without | drying at 60° C. | low |
| spruce | without | heat treatment 200° C., 3 hours | medium |
| spruce | with 10% cyanamide solution | drying at 60° C. | low |
| spruce | with 10% cyanamide solution | heat treatment 200° C., 3 hours | high |
| birch | without | drying at 60° C. | low |
| birch | without | heat treatment 200° C., 3 hours | medium |
| birch | with 10% cyanamide solution | drying at 60° C. | low |
| birch | with 10% cyanamide solution | heat treatment 200° C., 3 hours | high |

The invention claimed is:

1. A method for improving a performance property of a wooden part, consisting essentially of:

(a) impregnating said wooden part with an aqueous cyanamide solution without additional cross-linking agents, wherein said aqueous cyanamide solution has a concentration of from 1% to 50% by weight, and (b) treating said wooden part with heat, at a temperature of from 130° C. to 250° C.

2. The method of claim 1, wherein said wooden part is spruce, fir, pine, birch, beech, maple, poplar, alder, lime, Douglas fir, ash, or oak.

3. The method of claim 1, wherein said aqueous cyanamide has a concentration of from 5% to 25% by weight.

4. The method of claim 1, wherein said aqueous cyanamide solution has a pH of from 3.0 to 7.0.

5. The method of claim 4, wherein said aqueous cyanamide solution has a pH of from 4.0 to 5.5.

6. The method of claim 1, wherein said aqueous cyanamide solution contains a preservative, a fungicide, an insecticide or a biocide, at a concentration of from 0.01% to 5.0% by weight.

7. The method of claim 6, wherein said preservative is a copper compound, a fluoride, a borate, a silicate, a phenol, or a 1,2,4-triazole.

8. The method of claim 6, wherein said insecticide is a phosphoric acid ester or a neonicotinoid.

9. The method of claim 1, wherein said aqueous cyanamide solution contains a flame retardant, a pigment, a dye, or an UV absorber.

10. The method of claim 9, wherein said flame retardant is a phosphate, a borate, or a sulfonate.

11. The method of claim 1, wherein said wood part is impregnated with said aqueous cyanamide solution at a temperature of from 0° C. to 60° C.

12. The method of claim 1, wherein said wood part is impregnated with said aqueous cyanamide solution at a temperature of from 20° C. to 40° C.

13. The method of claim 1, wherein said wood part is impregnated in a vacuum at a pressure of from 0.02 to 0.98 bar.

14. The method of claim 1, wherein said wood part is impregnated at a pressure range of from 1.02 to 15 bar.

15. The method of claim 1, wherein said wood part is treated with heat at a temperature of from 150° C. to 220° C.

16. The method of claim 1, wherein said wood part is treated with heat for from 1 to 36 hours.

17. The method of claim 16, wherein said wood part is treated with heat for from 2 to 12 hours.

18. The method of claim 9, wherein said wood part is heat treated at a pressure of from 1 to 10 bars.

19. A method for improving a performance property of a wooden part, consisting essentially of:

impregnating said wooden part with an aqueous cyanamide solution without additional cross-linking agents, wherein said aqueous cyanamide solution has a concentration of from 1% to 50% by weight, drying the wooden part, and subsequently treating said wooden part with heat, at a temperature of from 130° C. to 50° C.

20. A method for improving a performance property of a wooden part, comprising:

(a) impregnating said wooden part with an aqueous cyanamide solution, wherein said aqueous cyanamide solution has a concentration of from 1% to 50% by weight, and (b) treating said wooden part with heat, at a temperature of from 130° C. to 250° C., wherein no additional cross-linking agents other than cyanamide are added to the wooden part at any point prior to treating said wooden part with heat.

21. A method for improving a performance property of a wooden part, comprising:

impregnating said wooden part with an aqueous cyanamide solution, wherein said aqueous cyanamide solution has a concentration of from 1% to 50% by weight, drying the wooden part, and subsequently treating said wooden part with heat, at a temperature of from 130° C. to 250° C., wherein no additional cross-linking agents other than cyanamide are added to the wooden part at any point prior to treating said wooden part with heat.

* * * * *